US006245286B1

(12) United States Patent
Lonardi et al.

(10) Patent No.: US 6,245,286 B1
(45) Date of Patent: Jun. 12, 2001

(54) SWIVEL DEVICE WITH CANTILEVER ARM

(75) Inventors: Emile Lonardi, Bascharage (LU); Philippe Malivoir, Thionville (FR); Victor Kremer, Luxembourg (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/445,231

(22) PCT Filed: May 2, 1998

(86) PCT No.: PCT/EP98/02602

§ 371 Date: Dec. 3, 1999

§ 102(e) Date: Dec. 3, 1999

(87) PCT Pub. No.: WO98/56960

PCT Pub. Date: Dec. 17, 1998

(30) Foreign Application Priority Data

Jun. 12, 1997 (LU) ..... 90078

(51) Int. Cl.[7] ..... C21C 5/48
(52) U.S. Cl. ..... 266/273; 266/271
(58) Field of Search ..... 266/271, 272, 266/273

(56) References Cited

U.S. PATENT DOCUMENTS

| | | | |
|---|---|---|---|
| 3,765,663 | 10/1973 | Legille et al. | 266/42 |
| 4,247,088 | 1/1981 | Ueno et al. | 266/273 |
| 4,544,143 | 10/1985 | Cooper et al. | 266/273 |
| 4,557,468 * | 12/1985 | Mailliet et al. | 266/273 |
| 5,246,208 * | 9/1993 | Mailliet et al. | 266/271 |
| 5,395,095 * | 3/1995 | Marino et al. | 266/273 |

FOREIGN PATENT DOCUMENTS

| | | |
|---|---|---|
| 2 035 697 | 3/1972 | (DE) . |
| 28 22 605 | 11/1979 | (DE) . |

* cited by examiner

*Primary Examiner*—Scott Kastler
(74) *Attorney, Agent, or Firm*—Nath & Associates PLLC; Gary M. Nath; Marvin C. Berkowitz

(57) ABSTRACT

A device for swiveling a working unit between a rest position and a work position is disclosed. The unit has an arm and a support structure, one end of the arm being arranged in the support structure in such a way that it can swivel. A swivel arm with an actuating drive is positioned with one end arranged in the support structure in such a way that it can swivel. The other end of the swivel arm has an articulated connection with a lift drive, the second end of the lift drive has an articulated connection with the arm. The swiveling axis of the swivel arm is positioned at a set distance from the swiveling axis of the arm so that the lever arm can be raised. This allows the lift drive to transmit its power to the arm in a working position. This eccentric position of the swivel arm also allows the actuating drive of the swivel arm to switch largely without power when the arm is in the working position. The swiveling device is adapted for use for tap hole plugging machines.

24 Claims, 4 Drawing Sheets

SWIVEL DEVICE WITH CANTILEVER ARM

Figure 1:
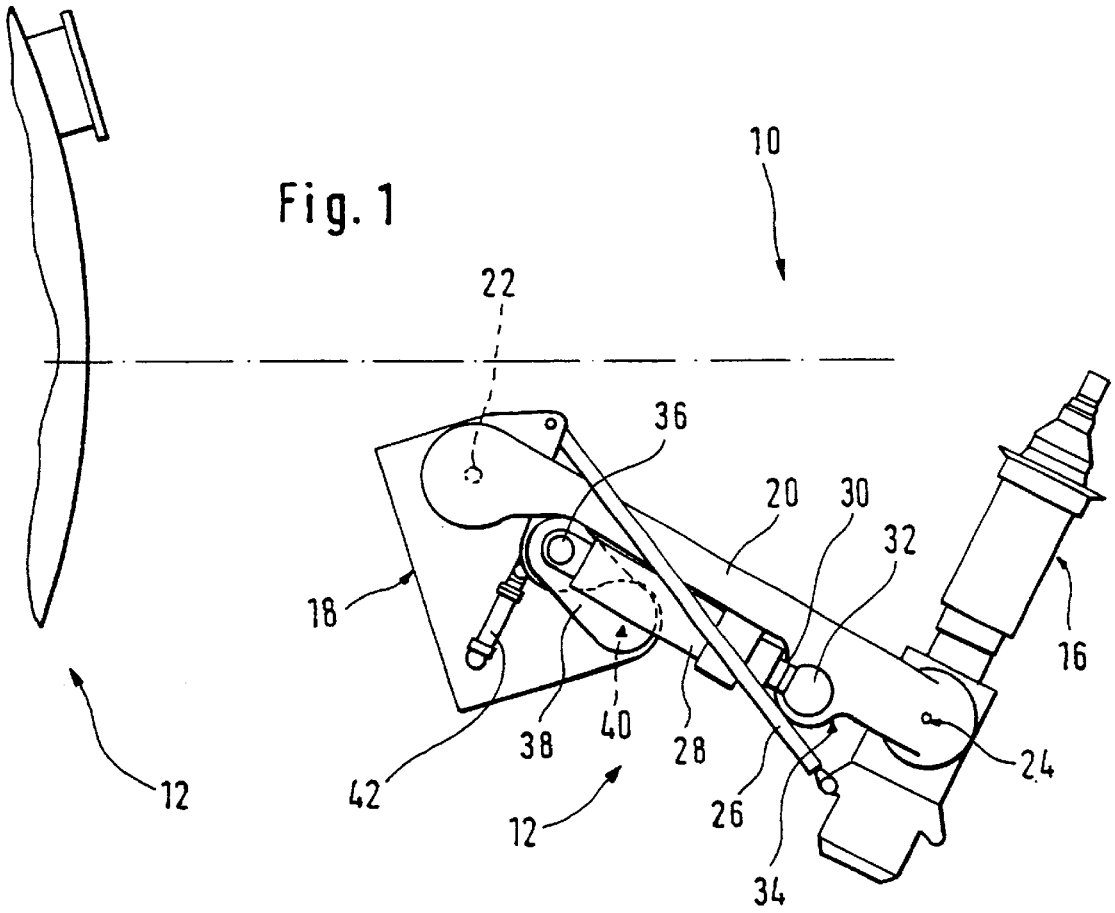

The invention relates to a swivel device with a cantilever arm for swivelling an operational element between a home position and an operational position. Such a device is used, for example, for swivelling a tap hole plugging gun from a home position into an operational position in front of the tap hole of a blast furnace, as well as for the subsequent pressing of the plugging gun against the tap hole.

A traditional swivel device for a tap hole plugging gun comprises, in a manner known per se, a fixed supporting structure and a cantilever arm. The latter has one of its two ends mounted in a swivelling manner in the supporting structure. In most cases, hydraulic cylinders are used to swivel the cantilever arm. The swivelling range of such a swivel device should, as a rule, be as great as possible, in order to be able to swivel the plugging gun as far as possible out of the range of the tapping channel. In addition to this, it must be considered that modern plugging guns are operating with increasingly high plugging pressures. As a result, the swivel device which is intended to press the plugging gun against the tap hole must also be designed for ever greater pressing forces.

In U.S. Pat. No. 3,765,663 two different embodiments of a swivel device for a tap hole plugging gun are described. In the first embodiment, a hydraulic cylinder is arranged between a fixed lever arm on the supporting structure of the cantilever arm and the rear end of the cantilever arm. The swivelling angle is limited with this device to approximately 90°, in order to be able to achieve a sufficiently great pressure force. For extending the swivelling range beyond 90°, U.S. Pat. No. 3,765,663 proposes the arrangement of a lever system between the hydraulic cylinder and the supporting structure. This lever system consists of a U-shaped element, one end of which being secured in a jointed manner to the supporting structure, and the other end of said element being connected in a jointed manner by means of a connecting rod to the cantilever arm. The hydraulic cylinder is arranged between the supporting structure and the U-shaped element.

In order to extend the swivelling angle beyond 90°, it has been suggested to use swivel devices with several hydraulic cylinders. DE-A-2035697 discloses for example a swivel device for a tap hole plugging gun which has a main cylinder for generating the swivelling movement and a smaller ancillary cylinder for overcoming the dead centre of the main cylinder. The main cylinder is arranged between a first lever arm at the rear end of the cantilever arm and a first fixed lever, which projects from the supporting structure of the cantilever arm. The auxiliary cylinder swivels the cantilever arm beyond the dead centre of the main cylinder. A hydraulic switch alters the stroke direction of the double-acting main cylinder when the dead centre is overrun.

U.S. Pat. No. 4,544,143 discloses a swivel device for a tap hole plugging gun which has two hydraulic cylinders of equal size. The first hydraulic cylinder is mounted between a fixed point on the supporting structure of the cantilever arm and a swivel frame. This swivel frame is mounted in a swivelling manner on the supporting structure, wherein its swivel axis is co-axial to the swivel axis of the cantilever arm. The second hydraulic cylinder is arranged between the swivel frame and the rear end of the cantilever arm. The two hydraulic cylinders are actuated either simultaneously or in a specific sequence. They both contribute their share to covering the swivel range of the cantilever arm. In the operational position, the first hydraulic cylinder must transmit onto the supporting structure the moment of force exercised by the second hydraulic cylinder on the swivel frame, when pressing the plugging gun against the tap hole. As the lever arms of both hydraulic cylinders are approximately of the same size, both cylinders are designed to be of equal strength. It is likewise to be noted that the lever arm which is available to the second hydraulic cylinder for transferring its force onto the cantilever arm is not influenced by the position of the swivel frame.

It is an object of the present invention,to improve the transfer of forces in the swivel device known from U.S. Pat. No. 4,544,143.

This object is achieved by means of a swivel device according to claim 1. Such a swivel device comprises, like the device disclosed in U.S. Pat. No. 4,544,143: a cantilever arm for supporting an operational element, a supporting structure in which the cantilever arm has one end mounted in a swivelling manner a swivel axis; a first linear drive, as a rule a hydraulic cylinder, to swivel the cantilever arm between its home position and its operational position, wherein the linear drive is connected to the cantilever arm by means of a first rotational joint; a swivel arm, which is mounted with one end in the supporting structure so as to be capable of swivelling about a swivel axis, wherein the linear drive is connected by means of a second rotational joint to the free end of the swivel arm; and an actuator drive for swivelling the swivel arm relative to the supporting structure.

According to the invention, the swivel axis of the swivel arm is not, as described in U.S. Pat. No. 4,544,143, located co-axially to the swivel axis of the cantilever arm, but at a certain distance from it. In other words, the swivel arm is mounted eccentrically to the cantilever arm. Due to this eccentric mounting of the swivel arm, it will be possible to increase the lever arm with which the linear drive exercises its force on the cantilever arm. By means of an adequate swivelling of the eccentrically-mounted swivel arm, it will also be possible to switch the actuator of the swivel arm largely free of force, when the cantilever arm is in the operational position. In other words, the swivel arm can be swivelled into a position in which the linear drive does not exercise any moment of force onto the actuator drive, when transferring its force onto the cantilever arm. When the cantilever arm is swivelled from its home position into its operational position, the hydraulic cylinder of the cantilever arm and the actuator drive of the swivel arm are actuated either simultaneously or in succession. The actuator of the swivel arm in the present invention also contributes its share to covering the swivel range of the cantilever arm. In comparison with the swivel device from U.S. Pat. No. 4,544,143, a swivel device according to the invention can, however, be more compact and cheaper, wherein neither the swivelling range nor the pressure force transferred on to the operational element need to be reduced.

In an advantageous embodiment of the invention, the swivel arm is capable of being swivelled by means of its actuator into an operational position, in which, in the operational position of the cantilever arm, the second rotational joint of the linear drive, is located in the immediate proximity of a plane, which contains the swivel axis of the swivel arm and the centre of the first rotational joint of the linear drive. In this position, the swivel arm should absorb no moment of force, or only a small moment of force, when the linear drive is actuated, so that the actuator must apply no force, or only a small force, in order to hold the swivel arm in its operational position. The actuator drive of the swivel arm can, accordingly, be designed substantially weaker than the linear drive of the cantilever arm.

In an alternative embodiment, the swivel arm can be swivelled into an operational position by its actuator drive, in which, in the operational position of the cantilever arm, the second rotational joint of the linear drive is located on the other side of a plane which contains the swivel axis of the swivel arm and the centre of the first rotational joint. In other words, the second rotational joint of the linear drive is swivelled beyond the position in which the swivel arm is free of any moment of force when the linear drive is actuated. It will be noted that during the swivelling operation, the moment of force which is exerted on the swivel arm changes its effective direction. In this embodiment of the swivel device, the supporting structure advantageously has an abutment, with which the swivel arm is in contact in the operational position. This abutment absorbs the moment of force which is introduced into the swivel arm when the linear drive is actuated, with the result that the actuator drive is entirely relieved. As an alternative to the abutment, the actuator drive may have an integrated limit stop, which defines the operational position of the swivel arm.

The swivel arm and its actuator drive are advantageously designed in such a way that the distance between the swivel axis of the cantilever arm and a straight line joining the centres of the two rotational joints of the linear drive increases, when the swivel arm is swivelled into its operational position. As a result of this, the lever arm with which the force of the linear drive is transferred onto the swivelling cantilever arm is increased. Because the pressure force, which is transferred through the swivel device onto the operational element, is proportional to the moment of force which is transferred by the linear drive onto the cantilever arm, the pressure force consequently increases in proportion to the lever arm referred to above. In other words, with a compact linear drive it is possible to generate very high pressure forces in the device as proposed.

The actuator drive is preferably a second linear drive, as a rule a hydraulic cylinder, which is connected in a jointed manner on one side to a fixed point of the supporting structure and, on the other side, to the swivel arm. This second linear drive can be designed substantially smaller than the first linear drive (i.e. it can feature a substantially smaller diameter). This makes it possible to achieve not only a more compact and cheaper design for the swivel device, but also to reduce the oil consumption of the swivel device. It remains to be noted that the actuator drive of the swivel arm can, if appropriate, be a rotary drive, such as, for example, an electric or hydraulic swivel motor.

In a preferred embodiment of the device according to the invention, the swivel arm features a home position in which the second rotational joint of the linear drive is arranged in such a way that, in the home position of the cantilever arm, the first linear drive lies essentially parallel to the cantilever arm. As a result of this, the swivel device becomes particularly compact in the home position, and therefore requires little space for erection.

Finally, it remains to be noted that a swivel device in accordance with the invention can be advantageously used in a tap hole plugging machine.

Figure 2:
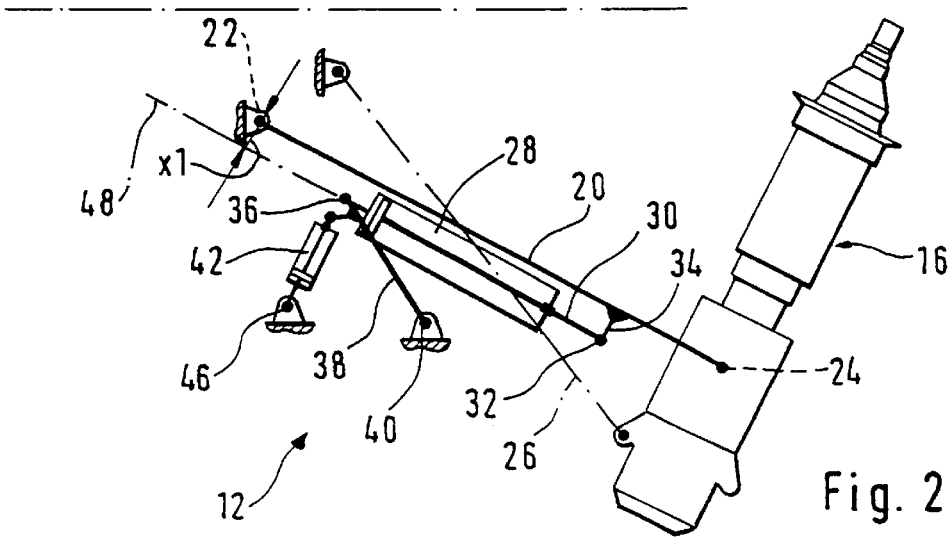
Figure 3:
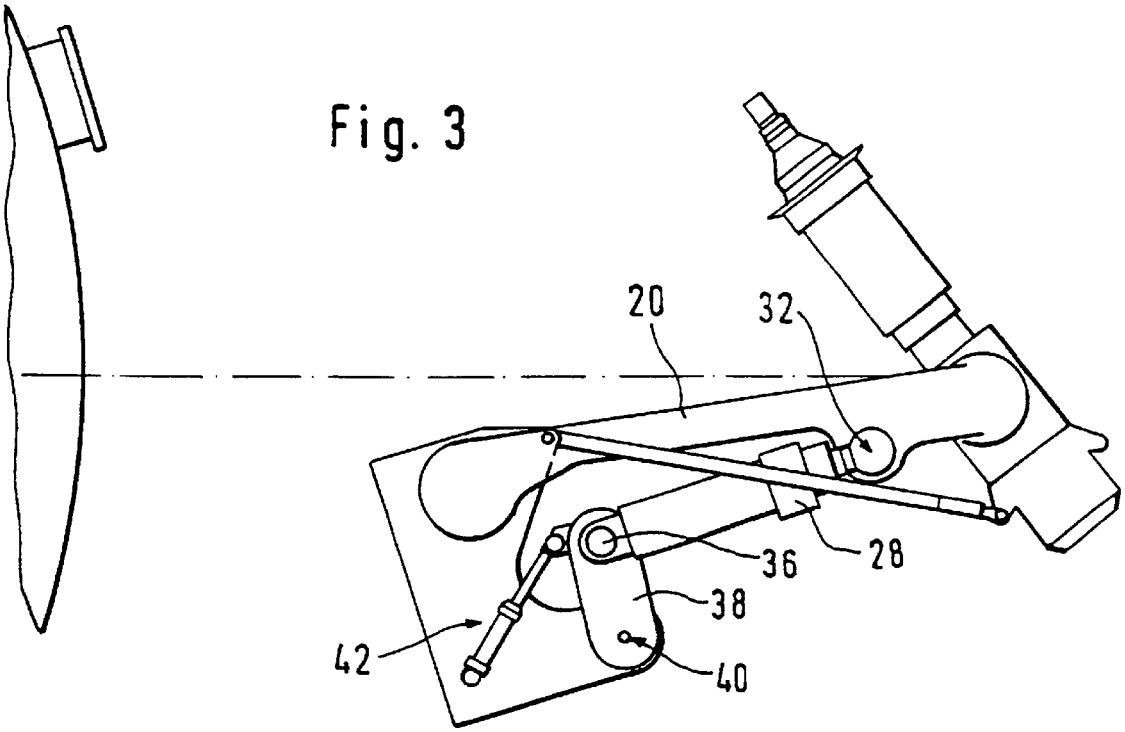
Figure 4:
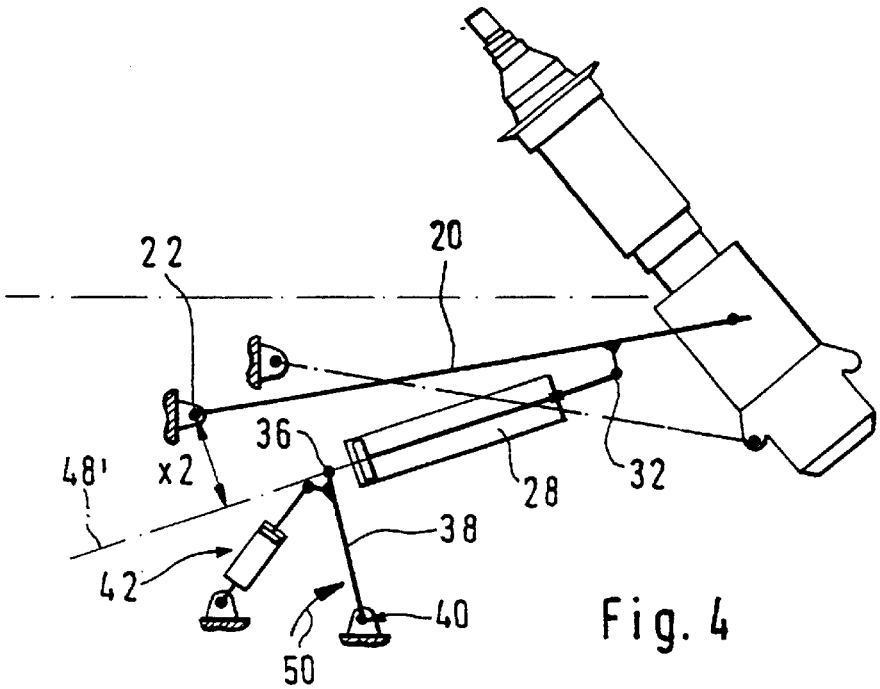
Figure 6:
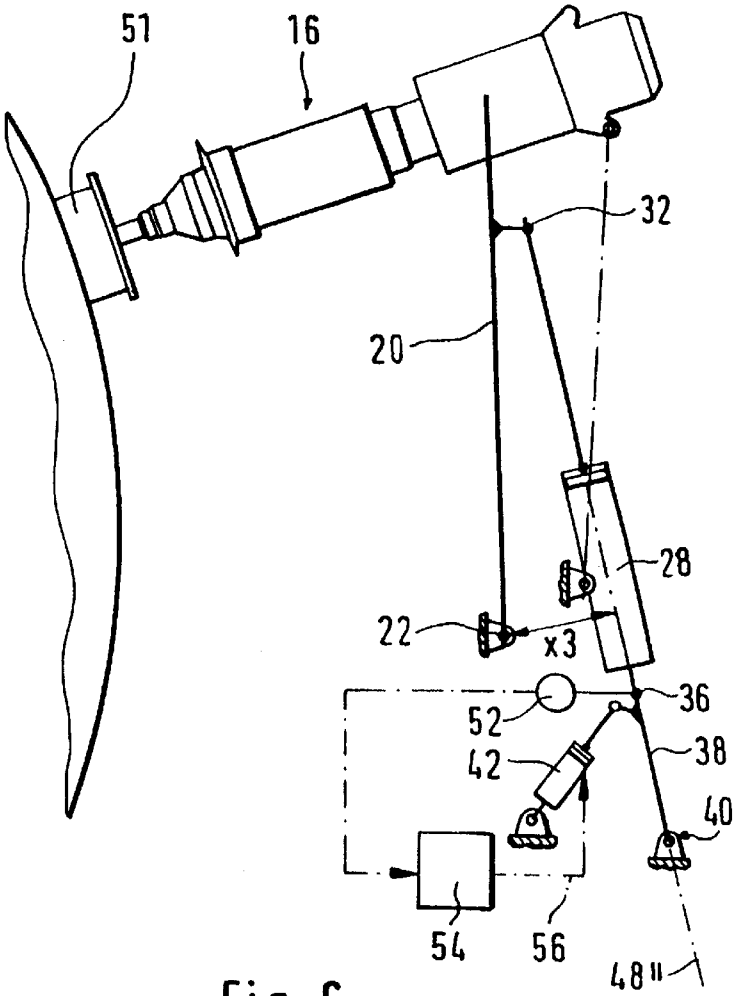
Figure 5:
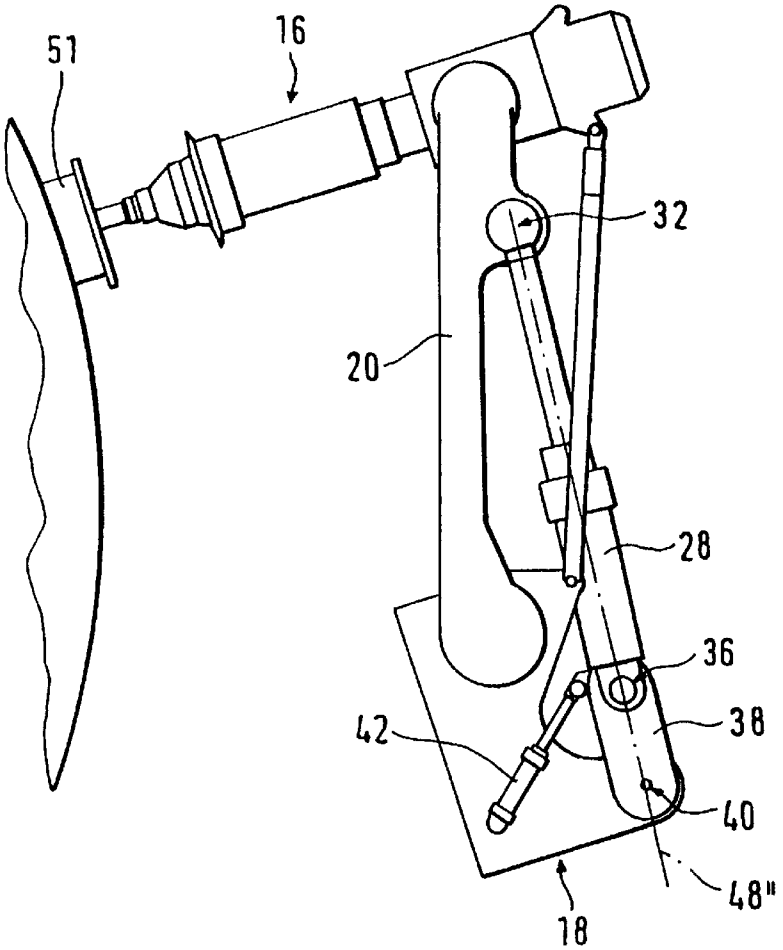
Figure 7:
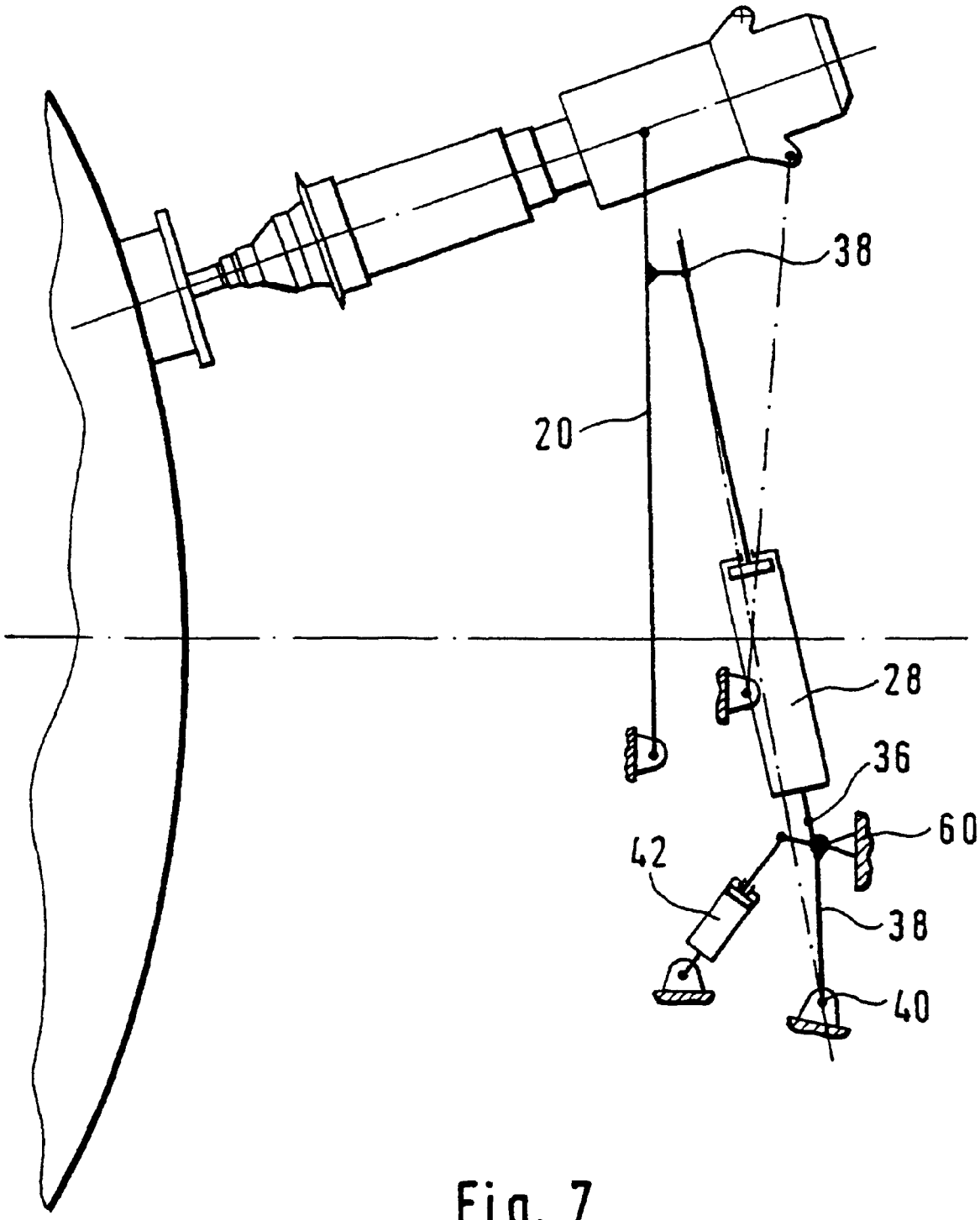

Embodiments of the invention are described in greater detail on the basis of the appended drawings. These show:

FIG. 1: A plan view of a tap hole plugging machine with a swivel device according to the invention, in the home position in front of the blast furnace;

FIG. 2: The same view as in FIG. 1, in which the swivel device is represented in schematic form;

FIG. 3: A plan view of the tap hole plugging machine from FIG. 1, in an intermediate position;

FIG. 4: The same view as in FIG. 3, in which the swivel device is represented in schematic form;

FIG. 5: A plan view of the tap hole plugging machine from FIG. 1, in an operational position at the tap hole;

FIG. 6: The same view as in FIG. 5, wherein the swivel device is shown in schematic form;

FIG. 7: The same view as in FIG. 6, with a design variation of the swivel device.

In FIG. 1, a tap hole plugging machine 10 according to the invention can be seen in its home position, in front of a blast furnace 12, which is schematically indicated by a circular arc. This tap hole plugging machine 10 consists essentially of a swivel device 14 according to the invention and a known tap hole plugging gun 16. The latter is not described here in any further detail.

The swivel device 14 includes a mounting pedestal, which forms a supporting structure 18 for a cantilever arm 20. Instead of being set on the ground, this supporting structure 18 can of course also be suspended. The cantilever arm 20 has one end mounted in a swivelling manner about a swivel axis (22) in the supporting structure 18. In FIG. 1, the position of the swivel axis of the cantilever arm 20 in the supporting structure 18 is shown by the reference number 22. This axis 22 is in most cases slightly inclined towards the blast furnace 12, relative to the vertical. At the free end of the boom 20 the tap hole plugging gun 16 is suspended in a swivelling manner at the free end of the cantilever arm 20. The position of the swivel axis of the tap hole plugging gun 16 in the cantilever arm 20 is shown by the reference number 24. In a known manner, a control rod 26 is connected in jointed fashion to the supporting structure 18 and to the rear end of the tap hole plugging gun 16. This control rod 26 determines the orientation of the tap hole plugging gun 16 as a function of the swivelling angle of the cantilever arm 20.

A hydraulic cylinder 28, which in FIG. 1 is located along the length of the cantilever arm 20, allows to swivel the cantilever arm 20 about its swivel axis 22. One end of this hydraulic cylinder 28, which is shown in the embodiment as a piston end 30, is connected to the front end of the cantilever arm 20 by means of a first rotational joint 32. The cantilever arm 20 advantageously has a lateral projection 34, to which the first rotational joint 32 is secured (see FIG. 2). The second end of the hydraulic cylinder 28, which in the embodiment shown is the foot of the cylinder, is connected by means of a second rotational joint 36 to a swivel arm 38. The latter is mounted in a swivelling manner to a fixed point on the supporting structure 18. The location of the swivel axis of the swivelling arm 38 in the supporting structure 18 is shown in the Figures by the reference number 40. It is an important feature of the present invention that the swivel axis 40 of the swivel arm 38 is located at a certain distance from the swivel axis 22 of the cantilever arm 20. In other words, supporting structure 18, cantilever arm 20, swivel arm 38 and hydraulic cylinder 28 form from a kinematic point of view a four-member drive assembly (18, 20, 38, 28) with four rotational joints (22, 32, 36, 40).

A second, considerably smaller hydraulic cylinder 42 is connected in a jointed manner on the one side to a fixed point 46 on the supporting structure 18, and, on the other side, to the swivel arm 38. This hydraulic cylinder 44 makes it possible for the swivel arm 38 to be swivelled relative to the supporting structure 18, wherein, in the drive assembly (18, 20, 38, 28), the relative position of the hydraulic cylinder 28 to the cantilever arm 20 changes. It follows that the lever arm of the hydraulic cylinder 28 relative to the swivel axis 22 of the cantilever arm 20 changes too.

In FIGS. 1 and 2, both hydraulic cylinders 28 and 42 are shown in their minimum length, i.e. the piston in which their rods are retracted. It can be seen that the swivel device 12 is extremely compact in this position, and requires little space in comparison with known machines. On the other hand, however, in this position the preconditions for a moment of force transfer from the hydraulic cylinder 28 onto the cantilever arm 20 are extremely unfavourable. In fact, the lever arm X1 for the force transfer, i.e. the distance between the swivel axis 22 of the cantilever arm 20 and the straight line 48, which connects the centres of the two rotational joints 32 and 36 of the hydraulic cylinder 28, is relatively small.

In FIGS. 3 and 4, the tap hole plugging machine 10 is shown in an intermediate position between the home position and the operational position. By making a comparison between FIG. 4 and FIG. 2, it can be seen that, in the interim, only the piston rod of the hydraulic cylinder 42 has been moved out. The swivel arm 38 has been swivelled in the direction of the arrow 50, about its swivel axis 40, from its home position into what is referred to as an operational position. Because of this swivel movement of the swivel arm 38, the cantilever arm 20 was swivelled out fromits home position, shown in FIGS. 1 and 2, into the intermediate position in as shown in FIGS. 3 and 4. In other words, the small hydraulic cylinder 42 has swivelled the swivel arm 20 over an angle of about 400 about its swivel axis 22. In FIG. 4 it can further be seen that, due to the swivel arm 38 being swivelled into its operational position, the lever arm X2, which, in the position in FIG. 4, is to be taken into consideration for a moment of force transfer from the hydraulic cylinder 28 onto the cantilever arm 20, is substantially greater than the corresponding lever arm X1 in FIG. 2.

In FIGS. 5 and 6, the tap hole plugging machine 10 is shown in its operational position. In this operational position, it is intended that the tap hole plugging gun 16 is pressed tight against a tap hole 51 at the blast furnace 12 by the cantilever arm 20. It must be emphasised in particular that in this operational position the second rotational joint 36 of the hydraulic cylinder 28 is located in the immediate proximity of a plane 48", which contains the swivel axis 40 of the swivel arm 38 and the centre of the first rotational joint 32 of the linear drive 28. This guarantees that the hydraulic cylinder 42 of the swivel arm 38 does not need to accommodate any components of the reaction force, at least in the ideal situation. In practice the hydraulic cylinder 42 may have to accommodate small force components, if the hydraulic cylinder 28 generates the pressure required at the plugging gun 16 while being supported by the supporting structure 18. In fact, if the centres of the two rotational joints 32 and 36 of the hydraulic cylinder 28, and the swivel axis 40 of the swivel arm 38, are all located precisely in the plane 48", the reaction force is conducted exclusively through the swivel arm 38, via the rotational joint 40, directly into the supporting structure 18. In other words, the hydraulic cylinder 28 does not exercise any torque on the swivel arm 38 in this position, since the line of effect of the force runs precisely through the swivel axis 40 of the swivel arm 38. In practice, however, slight alignment errors of the swivel arm 38 and the hydraulic cylinder 28 in the operational position of the cantilever arm 20 cannot be avoided. Such alignment errors may be caused, for example, by the fact that the swivel angle of the cantilever arm 20 may change slightly from the home position into the operational position. In order to take account of these alignment errors, the hydraulic cylinder 42 is preferably designed in such a way that it is capable of compensating for a residual moment which is induced in the swivel arm 38 by the hydraulic cylinder 28, when the plugging gun 16 is pressed against the tap hole. In order to be able to adapt the final position of the swivel arm 38 to different swivel angle values of the cantilever arm 20, the stroke of the hydraulic cylinder 42 is advantageously designed so as to be adjustable. To achieve this, the hydraulic cylinder 42 may, for example, have a mechanically adjustable limit stop. However, if the swivel angle of the cantilever arm 20 must be changed too much, it is advisable to use a sensor to detect the compensation error of the swivel arm 38 and to automatically adjust the stroke of the hydraulic cylinder 42 until the alignment error has been eliminated; i.e. until the centres of the two rotational joints 32 and 36 of the hydraulic cylinder 28 and the swivel axis 40 of the swivel arm 38 are located in a plane 48". Such an adjustment is schematically represented in FIG. 6. Reference number 52 indicates an angle sensor, which measures the angle between the swivel arm and the hydraulic cylinder 28 and passes this value on to a controller 54. The output signal 56 from this controller 54 is then used for controlling the stroke of the hydraulic cylinder 42. For the purpose of adjusting the hydraulic cylinder 42, the hydraulic cylinder 28 must, if necessary, be shortly relieved.

In FIG. 6, the distance X3 represents the lever arm which is to be taken into account for the transfer of the moment of force of the hydraulic cylinder 28 onto the cantilever arm 20. It may be noted that this lever arm X3 is relatively large in comparison with known tap hole plugging machines. The hydraulic cylinder 28 could, as a result, be designed smaller than usual, without the pressure force being reduced. It should be emphasised in particular that this increased lever arm X3 is obtained without any negative effect on the compactness of the machine in the home position.

With regard to the function of the machine, it should further be noted that under normal circumstances it is first the small hydraulic cylinder 42 which is actuated, and only then the large hydraulic cylinder 28, when the cantilever arm is swivelled from the home position into the operational position. It is, however, likewise possible to actuate both hydraulic cylinders 28, 42 simultaneously, or to actuate the small hydraulic cylinder 42 only shortly before reaching the operational position.

In FIG. 7, a further possible embodiment of the swivel device according to the invention is shown in the operational position. If FIG. 7 is compared with FIG. 6, it can be seen that the second rotational joint 36 of the linear drive 28 lies on the far side of the plane 48", which contains the swivel axis 40 of the swivel arm 38 and the centre of the first rotational joint 32 of the linear drive 28. In this position, the swivel arm 38 is in contact with an abutment 60 of the supporting structure 18. In this embodiment of the swivel device, the actuator drive 42 does not absorb any reaction forces in the operational position of the cantilever arm 20, when transferring the moment of force via the hydraulic cylinder 28 onto the cantilever arm 20. Reaction forces are in fact introduced via the rotational bearing 40 or the abutment 60 respectively directly into the supporting structure 18. As an alternative, the position of the swivel arm 38 according to FIG. 7 could also be secured by an internal stroke limitation arrangement of the hydraulic cylinder 42; i.e. without an additional abutment 60 on the supporting structure. In this case, the hydraulic cylinder 42 would have to accommodate tensile forces , however, during the transfer of the moment of force via the hydraulic cylinder 28 onto the cantilever arm 20.

In the described swivelling device, the two hydraulic cylinders 28, 42, demonstrate their minimum length in the home position. The swivelling of the cantilever arm 20 from its home position into its operational position is accordingly effected by the extension of their piston rods. It remains to be noted that it is easily possible for the swivel device to be re-engineered in such a way that the swivelling of the cantilever arm 20 from its home position into its operational position can be effected by the retraction of the piston rods of both hydraulic cylinders.

With regard to the oil consumption of the swivel device, the following points should be noted. For a specific swivel angle of the cantilever arm 20, the oil consumption of the weaker hydraulic cylinder 42 is naturally far less than the oil consumption of the hydraulic cylinder 28. The total oil consumption for the swivelling of the cantilever arm 20 from its home position into its operational position is, as a consequence, sharply reduced by the swivelling capacity of the hydraulic cylinder 42. It follows that the hydraulic cylinder 28 may have a larger diameter, without increasing the overall oil consumption for the same swivel angle, in comparison with known swivel devices. It follows that the pressure force of the swivel device can be increased by choosing a stronger hydraulic cylinder 28, without substantially increasing the oil consumption of the swivel device. In this context it is to be noted that a smaller oil consumption implies not only savings in costs with regard to the hydraulic system but in most cases further achieves a lower energy consumption.

In conclusion it is noted that the described swivel device is of particular advantage if a large swivel angle and a high pressure force are required.

What is claimed is:

1. A device for swivelling an operational element between a home position and an operational position, comprising:

a cantilever arm which supports said operational element;

a supporting structure in which said cantilever arm has one end mounted in a swivelling manner so as to be capable of swivelling about a cantilever arm swivel axis;

a first linear drive for swivelling said cantilever arm between its home position and its operational position, wherein said linear drive is connected by means of a first rotational joint to said cantilever arm;

a swivel arm which is mounted with one end in said supporting structure, so as to be capable of swivelling about a swivel arm swivel axis which is offset from said cantilever arm swivel axis, wherein said first linear drive is connected by means of a second rotational joint to a free end of said swivel arm; and an actuator drive for swivelling said swivel arm relative to said supporting structure.

2. The device according to claim 1, wherein said swivel arm is capable of being swivelled by its actuator drive into an operational position, wherein, in said operational position of said cantilever arm, said second rotational joint of said first linear drive, is located in the immediate proximity of a plane, which contains said swivel arm swivel axis and the center of said first rotational joint of said first linear drive.

3. The device according to claim 1, wherein said swivel arm is capable of being swivelled by its actuator drive into an operational position, in which, in said operational position of said cantilever arm, said second rotational joint of said first linear drive is located on the other side of a plane, which contains said swivel arm swivel axis and the center of said first rotational joint of said first linear drive.

4. The device according to claim 3, wherein said swivel arm is mechanically locked in its operational position.

5. The device according to claim 4, wherein said swivel arm is, in its operational position, in contact with an abutment of said supporting structure.

6. The device according to claim 4, wherein said actuator drive has a limit stop, which determines said operational position of said swivel arm.

7. The device as claimed in claim 1, wherein, when said swivel arm is swivelled into its operational position, the distance between said cantilever arm swivel axis and a straight line connecting said two rotational joints of said linear drive increases.

8. The device as claimed in claim 1, wherein said actuator drive of said swivel arm is a second linear drive, which is connected in an articulated manner on one side to a fixed point of said supporting structure, and, on the other side, to said swivel arm, wherein said second linear drive is considerably weaker than said first linear drive.

9. The device as claimed in claim 1, wherein said actuator drive of said swivel arm is a rotational drive.

10. The device as claimed in claim 1, wherein said swivel arm is capable of being swivelled by said actuator drive of said swivel arm into a home position, in which said second rotational joint of said linear drive is arranged in such a way that in said home position of said cantilever arm said first linear drive is located essentially parallel to said cantilever arm.

11. The device as claimed in claim 1, wherein said first linear drive is arranged laterally along said cantilever arm, wherein said first rotational joint of said first linear drive is secured laterally at a free end of said cantilever arm.

12. The device as claimed in claim 1, wherein said first linear drive is a hydraulic cylinder.

13. A tap hole plugging machine comprising:

a tap hole plugging gun;

a cantilever arm having a first end and a second end, said plugging gun being supported at said first end thereof;

a supporting structure in which said cantilever arm has its second end mounted in a swivelling manner, so as to be capable of swivelling about a cantilever arm swivel axis;

a first linear drive for swivelling said cantilever arm between a home position and an operational position, wherein said linear drive is connected by means of a first rotational joint to said cantilever arm;

a swivel arm which is mounted with one end in said supporting structure, so as to be capable of swivelling about a swivel arm swivel axis, which is offset from said cantilever arm swivel axis, wherein said first linear drive is connected by means of a second rotational joint to a free end of said swivel arm; and an actuator drive for swivelling said swivel arm relative to said supporting structure.

14. The tap hole plugging machine as claimed in claim 13, wherein said swivel arm is capable of being swivelled by its actuator drive into an operational position, wherein, in said operational position of said cantilever arm, said second rotational joint of said first linear drive is located in the immediate proximity of a plane, which contains said swivel arm swivel axis and the center of said first rotational joint of said first linear drive.

15. The tap hole plugging machine as claimed in claim 13, wherein said swivel arm is capable of being swivelled by its actuator drive into an operational position, in which, in said operational position of said cantilever arm, said second rotational joint of said linear drive is located on the other side of a plane, which contains said swivel arm swivel axis and the center of said first rotational joint of said first linear drive.

16. The tap hole plugging machine as claimed in claim 15, wherein said swivel arm is mechanically locked in its operational position.

17. The tap hole plugging machine as claimed in claim 16, wherein said swivel arm is, in its operational position, in contact with an abutment of said supporting structure.

18. The tap hole plugging machine as claimed in claim 17, wherein said actuator drive has a limit stop, which determines said operational position of said swivel arm.

19. The tap hole plugging machine as claimed in claim 13, wherein, when said swivel arm is swivelled into its operational position, the distance between said cantilever arm swivel axis and a straight line connecting said two rotational joints of said linear drive increases.

20. The tap hole plugging machine as claimed in claim 13, wherein said actuator drive of said swivel arm is a second linear drive, which is connected in an articulated manner, on one side, to a fixed point of said supporting structure, and, on the other side, to said swivel arm, wherein said second linear drive is considerably weaker than said first linear drive.

21. The tap hole plugging machine as claimed in claim 13, wherein said actuator drive of said swivel arm is a rotational drive.

22. The tap hole plugging machine as claimed in claim 13, wherein said swivel arm is capable of being swivelled by said actuator drive of said swivel arm into a home position, in which said second rotational joint of said linear drive is arranged in such a way that in said home position of said cantilever arm said first linear drive is located essentially parallel to said cantilever arm.

23. The tap hole plugging machine as claimed in claim 13, wherein said first linear drive is arranged laterally along said cantilever arm, wherein said first rotational joint of said first linear drive is secured laterally at a free end of said cantilever arm.

24. The tap hole plugging machine as claimed in claim 13, wherein said first linear drive is a hydraulic cylinder.

* * * * *